United States Patent [19]

Shafranski

[11] Patent Number: 4,931,141

[45] Date of Patent: Jun. 5, 1990

[54] PAPER TAILING DEVICE

[75] Inventor: David J. Shafranski, Stevens Point, Wis.

[73] Assignee: Consolidated Papers, Inc., Wisconsin Rapids, Wis.

[21] Appl. No.: 376,239

[22] Filed: Jul. 6, 1989

[51] Int. Cl.[5] ..... D21F 7/00

[52] U.S. Cl. ..... 162/255; 162/193; 34/117; 34/120; 226/92

[58] Field of Search ..... 162/193, 255, 290, 286; 34/117, 120; 226/12, 91, 92, 172

[56] References Cited

U.S. PATENT DOCUMENTS

| | | | |
|---|---|---|---|
| 3,355,349 | 11/1967 | Devlin | 162/193 |
| 3,756,912 | 9/1973 | Rooney | 162/255 |
| 4,014,740 | 3/1977 | Koponen et al. | 162/289 |
| 4,566,946 | 1/1986 | Koponen et al. | 162/359 |
| 4,726,502 | 2/1988 | Cryderman | 162/193 |

*Primary Examiner*—Karen M. Hastings

*Attorney, Agent, or Firm*—Juettner, Pyle, Lloyd & Verbeck

[57] ABSTRACT

A paper tailing device accommodates automatic transfer of an initial portion of a paper web across a gap in a paper making machine during guiding of the initial portion through the machine. The paper tailing device comprises a pair of brackets, one on each side of the gap and each carrying a pair of sheaves over which carrier ropes extend. During guiding of the initial portion of the web through the machine, a side edge of the web is gripped between the carrier ropes, and at the sheaves, the ropes define an outgoing nip on one side of the gap and an incoming nip on the opposite side. To transfer the leading end of the web across the gap, the brackets are moved close together in the gap to place the nips in close facing relationship, so that as the leading end of the web exits the outgoing nip it is automatically introduced into the incoming nip. After the initial portion of the web is guided through the machine, tensioning of the web by the machine causes the web to shift sideways out from between the carrier ropes to its normal path of travel through the machine, whereupon the brackets are moved apart and out of the gap. Moving the brackets out of the gap accommodates unobstructed movement of a calibrating head through the gap during operation of the machine.

16 Claims, 3 Drawing Sheets

R1
R1
R1
R1
W
R1,R2
96
80
W
N1
26
G
W
98
84
82
86
N2
N1
88
R1,R2
90
N2
R2
R2
92
R2
R2
94

PAPER TAILING DEVICE

BACKGROUND OF THE INVENTION

The present invention relates to paper making machines, and in particular to a paper tailing device for transferring a leading end of an initial portion of a paper web across a gap in a paper making machine during guiding of the web through the machine.

In making paper, a damp web of paper from a press section is carried through a drying section that includes heated rolls around which the web wraps for being heated and dried. As long as the web is continuous, it guides itself through the dryer. However, upon start-up of paper making or should the web break, it is necessary to guide an initial portion of or to thread the web through the drying section. Conventionally, threading is accomplished by gripping a side edge of the web between a pair of overlapping carrier ropes that run in sheaves alongside the path of travel of the web and guide the web from an inlet to an outlet of the drying section. Once the web is guided through the dryer, the dryer tensions the web and causes its edge to move from between the carrier ropes as the web shifts to its normal run position.

Paper drying sections often have a calibrating head that moves within a gap transversely across and beyond the edges of the web to sense web moisture, thickness, etc.. Conventionally, the carrier ropes for guiding the web through the drying section extend alongside the path of travel of the web through the dryer. The arrangement must therefore be such that the carrier ropes do not interfere with or block movement of the calibrating head while the dryer is operating.

According to one prior technique, a single pair of carrier ropes is used to guide the web through the drying section. The carrier ropes extend across a space at the end of the gap into which the calibrating head moves, and after the web is guided through the dryer the ropes are cut to accommodate unimpeded movement of the calibrating head into the space during operation of the dryer. This technique necessitates replacing the carrier ropes on the drying section each time that a web is to be guided through the dryer.

According to another prior technique, two pairs of carrier ropes are used to guide the web through the drying section. One pair of ropes leads to and defines an outgoing nip on one side of the gap traversed by the calibrating head, and the other pair leads away from and defines an incoming nip on the other side of the gap. The outgoing and incoming nips are spaced apart by at least the width of the gap to accommodate unimpeded movement of the calibrating head during operation of the dryer. In consequence, the incoming nip is spaced sufficiently far from the outgoing nip that the leading end of the web is not automatically introduced into the incoming nip as the web is guided through the dryer, as a result of which the web, upon exiting the outgoing nip, falls through the gap into a broke pit until an operator is able to manually introduce the web into the incoming nip.

OBJECT OF THE INVENTION

The primary object of the present invention is to provide a paper tailing device that automatically transfers the leading end of an initial portion of a paper web across a gap in a paper making machine during guiding of the initial portion through the machine.

SUMMARY OF THE INVENTION

In accordance with the present invention, there is provided a paper tailing device for a paper making machine in which an initial portion of a paper web is guided through the machine by being gripped along its side edge between overlapping carrier ropes that guide the initial portion through the machine, and in which there is a gap across which the initial portion is to be transferred. The paper tailing device comprises a pair of upstream sheaves at an upstream side, with respect to the direction of web travel, of the gap, and the carrier ropes are adapted to extend over the upstream sheaves and define an outgoing nip from the ropes at the upstream sheaves. A pair of downstream sheaves are at a downstream side of the gap, and the carrier ropes are adapted to extend over the downstream sheaves and define an incoming nip to the ropes at the downstream sheaves. Also provided are means for moving the upstream and downstream pairs of sheaves relative to and toward each other, during guiding of the initial portion of the web through the machine, to place the outgoing and incoming nips in close facing relationship, so that a leading edge of the initial portion of the web, upon exiting the outgoing nip from the carrier ropes, is automatically introduced into the incoming nip to the ropes and thereby transferred across the gap. The means for moving the upstream and downstream pairs of sheaves also moves the same relative to and away from each other, after completion of guiding the web through the machine, to move the pairs of sheaves to opposite sides and outside of the gap.

The foregoing and other objects, advantages and features of the invention will become apparent upon a consideration of the following detailed description, when taken in conjunction with the accompanying drawings.

DETAILED DESCRIPTION OF THE DRAWINGS

In general terms, the invention contemplates a paper tailing device for use with a paper making machine, and in the disclosed embodiments for use with a paper drying section in which there is a gap across which a paper web extends and through which a calibrating head is moved transversely of the web to sense web moisture, thickness, etc. During guiding of an initial portion of a web through the drying section, the paper tailing device operates to automatically transfer the leading end of the web across the gap. The device includes two air cylinders with piston rods, and attached to the piston rods are respective brackets, each carrying two rope sheaves. Initial guiding of the web through the dryer is accomplished by gripping a side edge of the web between a pair of overlapping carrier ropes that extend and are moved alongside the path of travel of the web to guide the web through the dryer. The brackets and their associated sheaves are mounted to opposite sides of the gap, and the carrier ropes extend over respective ones of the sheaves to define between them an outgoing nip on an upstream side of the gap and an incoming nip on a downstream side of the gap.

When the drying section is operating, the cylinders retract the brackets of the paper tailing device to move the brackets, sheaves and carrier ropes out of the gap and out of a space at an end of the gap into which the calibrating head moves, so that movement of the calibrating head transversely through the gap and beyond side edges of the web is unimpeded. However, during guiding of an initial portion of a paper web through the drying section, to accommodate automatic transfer of the leading end of the web across the gap, the cylinders move the brackets and their associated sheaves into close relationship at a side end of the gap to place the outgoing and incoming nips into closely facing relationship, so that the leading side edge of the web, upon exiting the outgoing nip between the carrier ropes and sheaves on the upstream side of the gap, is automatically introduced into the incoming nip between the carrier ropes and sheaves on the downstream side of the gap. Upon completion of threading or guiding the web through the drying section, the drying section tensions the web and causes its edge to move from between the carrier ropes as the web shifts sideways to its normal run position, whereupon the cylinders retract the brackets, sheaves and carrier ropes from the space at the end of the gap so that the calibrating head can move into the space.

Figure 1:
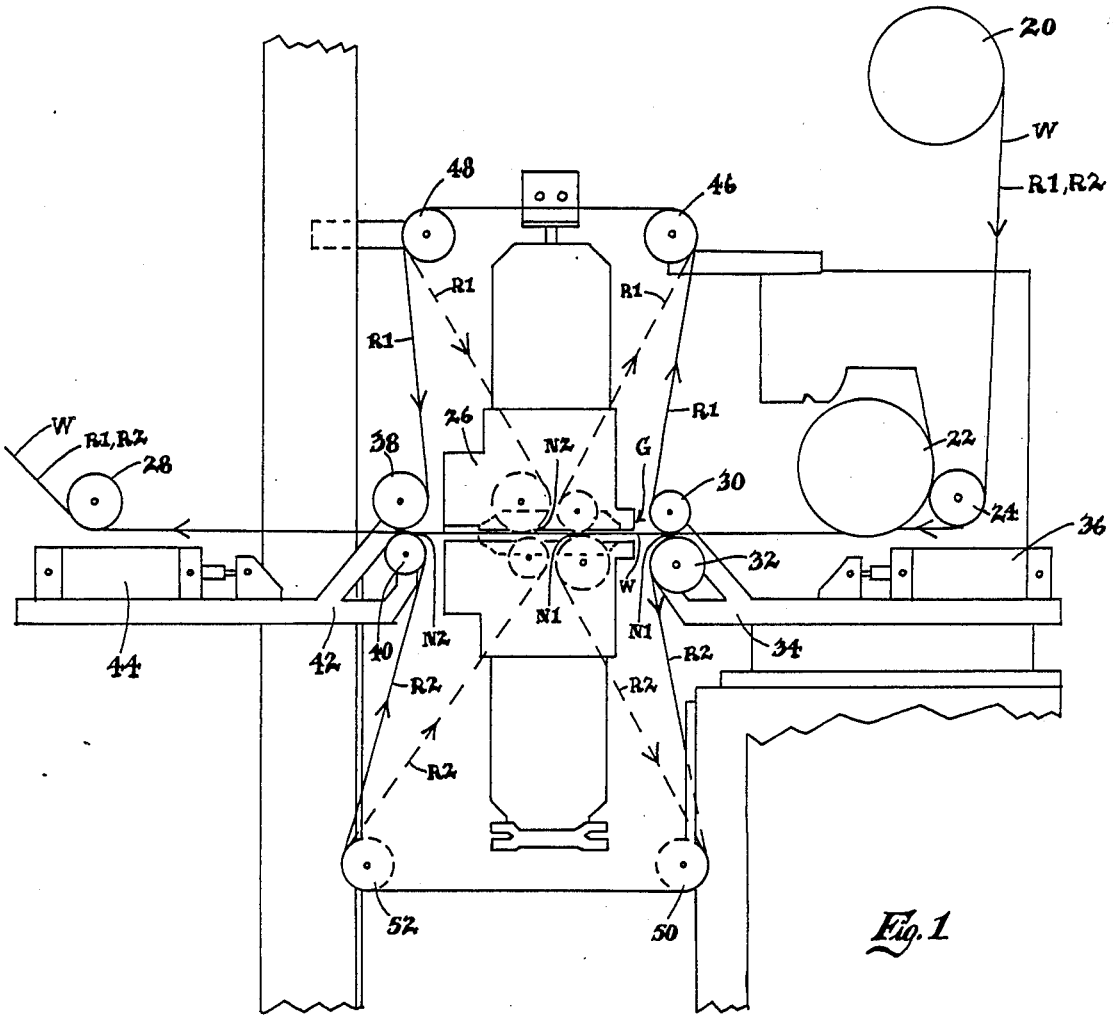
FIG. 1 is a side elevation view of a paper tailing device constructed according to one embodiment of the invention.
Figure 2:
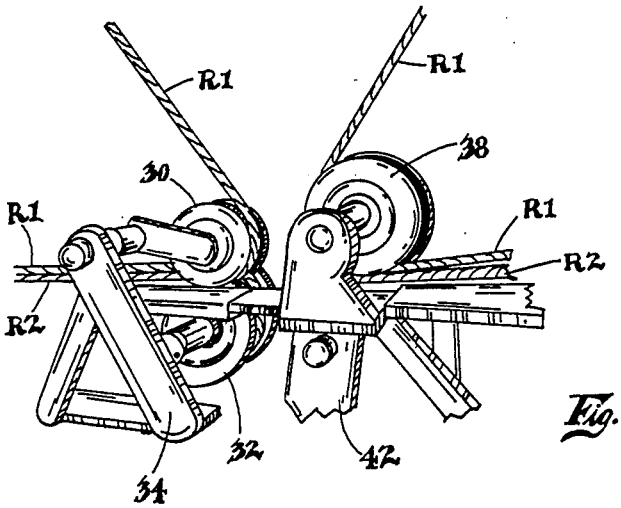
FIG. 2 is a perspective rear view of sheaves and brackets of the paper tailing device.

Considering the paper tailing device and its operation in greater detail, FIG. 1 shows an outlet end of a paper drying section, whereat there is located a paper tailing device according to one embodiment of the invention. The drying section has a large number of heated drums around which a paper web wraps for being heated and dried, only the last two heated drums 20 and 22 of which are shown. A web W traveling through the dryer in the direction shown by arrows wraps the drum 20, from which it passes around a guide roll 24 to the drum 22, and then through a gap G where its characteristics are sensed by a calibrating head 26 that is moved transversely through the gap back and forth across the web. After leaving the gap, the web passes around a guide roll 28 and is led to and wound upon a take-up roll (not shown). As the calibrating head moves transversely back and forth across the surface of the web within the gap, at opposite ends of its travel it moves outwardly beyond side edges of the web.

As long as the web W is continuous, it guides itself through the drying section. However, upon start-up of paper making or should the web break, it is necessary to thread or guide an initial portion of the web through the dryer. Conventionally, the initial portion of the web is guided through the drying section by gripping a side edge of the web between a pair of overlapping carrier ropes that extend and move alongside the path of travel of the web through the dryer. The carrier ropes guide the web from an inlet to the outlet of the dryer, thereby ensuring that the leading end of the web follows the intended path of travel of the web through the dryer. Once the initial portion of the web is guided through the dryer and onto the take-up roll, operation of the dryer tensions the web and causes its edge to move from between the carrier ropes as the web shifts to its normal run position.

FIG. 1 shows a pair of overlapping carrier ropes R1 and R2, which run in sheaves on the heated roll 20, guide roll 24 and heated roll 22 to the paper tailing device. The paper tailing device includes upstream sheaves 30 and 32 carried on a bracket 34 that is moved by a pneumatic cylinder 36, and downstream sheaves 38 and 40 carried on a bracket 42 that is moved by a pneumatic cylinder 44. It being understood the terms "upstream" and "downstream" are with reference to the direction of travel of the web W, the upstream sheave 30 has a smaller diameter than the sheave 32 and the downstream sheave 40 has a smaller diameter than the sheave 38. After passing the heated roll 22, the carrier rope R1 wraps the sheave 30, from which it passes upwardly to guide sheaves 46 and 48, and then downwardly to the sheave 38 and guide roll 28. The carrier rope R2, after passing the heated roll 22, wraps the sheave 32, from which it passes downwardly to guide sheaves 50 and 52, and then upwardly to the sheave 40 and guide roll 28. At the sheaves 30 and 32 the carrier ropes R1 and R2 define between them an outgoing nip N1, and at the sheaves 38 and 40 the ropes define an incoming nip N2.

The upstream sheaves 30 and 32 and the downstream sheaves 38 and 40 and their brackets 34 and 42 are normally located on opposite sides and outside of the gap G through which the calibrating head 26 moves transversely from side-to-side across the web W to obtain measurements of web characteristics. Locating the sheaves and brackets outside of the gap is necessary because when the drying section is operating the calibrating head moves beyond the side edges of the web, and if the sheaves were located within the gap they would be struck by and interfere with movement of the calibrating head. In their locations to opposite sides and outside of the gap the sheaves represent a generally conventional arrangement employed in a drying section, and absent more, upon the leading end of an initial portion of a paper web being moved by the carrier ropes R1 and R2 to the sheaves 30 and 32, as it exits the outgoing nip N1, the ingoing nip N2 will be spaced too far from the outgoing nip for the leading end of the web to automatically enter it. As a result, the web will fall through the gap into a broke pit until an operator is able to manually transfer the web into the incoming nip.

Unlike the conventional practice of manually transferring the initial portion of the web W across the gap G from the outgoing nip N1 to the incoming nip N2, the paper tailing device of the invention accommodates automatic transfer of the leading end of the web across the gap. To this end, piston rods of the pneumatic cylinders 36 and 44 are normally retracted during operation of the drying section to maintain the upstream sheaves 30 and 32 and the downstream sheaves 38 and 40 and their brackets 34 and 42 outside of the gap, so that the sheaves, brackets and carrier ropes R1 and R2 do not block movement of the calibrating head 26. However, during guiding of an initial portion of a web through the drying section, at which time the calibrating head is inoperative and positioned away from the sheaves, the pneumatic cylinders are operated to extend their piston rods and move their associated brackets toward each other to place the upstream and downstream sheaves into closely facing relationship in the gap, as shown in dashed lines. This also places the outgoing nip from and the incoming nip to the carrier ropes into closely facing relationship, so that the leading side edge of the web, upon exiting the outgoing nip, is introduced into and automatically enters the incoming nip for being guided to the take-up roll. Upon completion of the threading operation, the drying section tensions the web and causes its edge to move from between the carrier ropes as the web shifts sideways to its normal run position, whereupon the pneumatic cylinders are operated to retract the brackets, sheaves and carrier ropes from the space at the end of the gap into which the traversing calibrating head moves in its operation.

Figure 3:
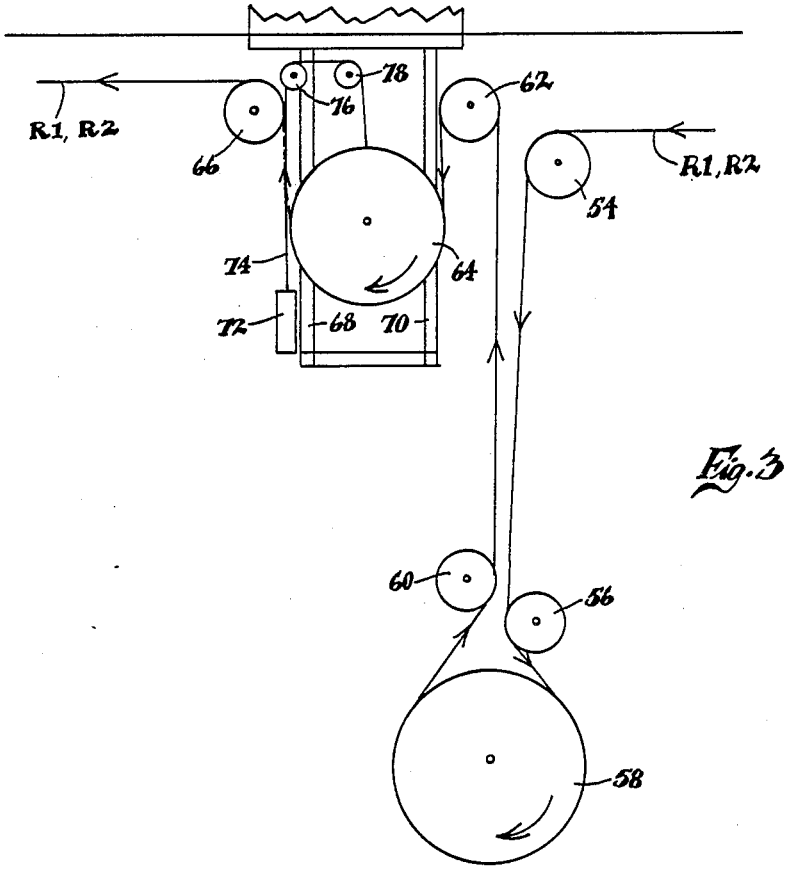
FIG. 3 is a side elevation view of a carrier rope slack take-up mechanism for use with the paper tailing device.

The carrier ropes R1 and R2 form endless loops, and since their lengths within the drying section effectively change as the upstream sheaves 30 and 32 and downstream sheaves 38 and 40 are moved toward and away from each other, means are provided for giving and taking up slack in the ropes. As seen in FIG. 3, such means may comprise sheaves 54 and 56 which lead the carrier ropes to a driver sheave 58, from which the carrier ropes are led by sheaves 60 and 62 to a carrier rope slack take-up mechanism. The mechanism includes a sheave 64 around which the carrier ropes pass to a guide sheave 66. The sheave 64 is rotatably mounted on a bracket (not shown) that is vertically slidable along a pair of posts 68 and 70, and the weight of the bracket and sheave 64 are partially counterbalanced by a weight 72 connected to the bracket by a rope 74 which passes over a pair of sheaves 76 and 78. As is apparent, the sheave 64 will move up and down to the extent necessary to accommodate changes in the lengths of the carrier ropes within the drying section.

Figure 4:
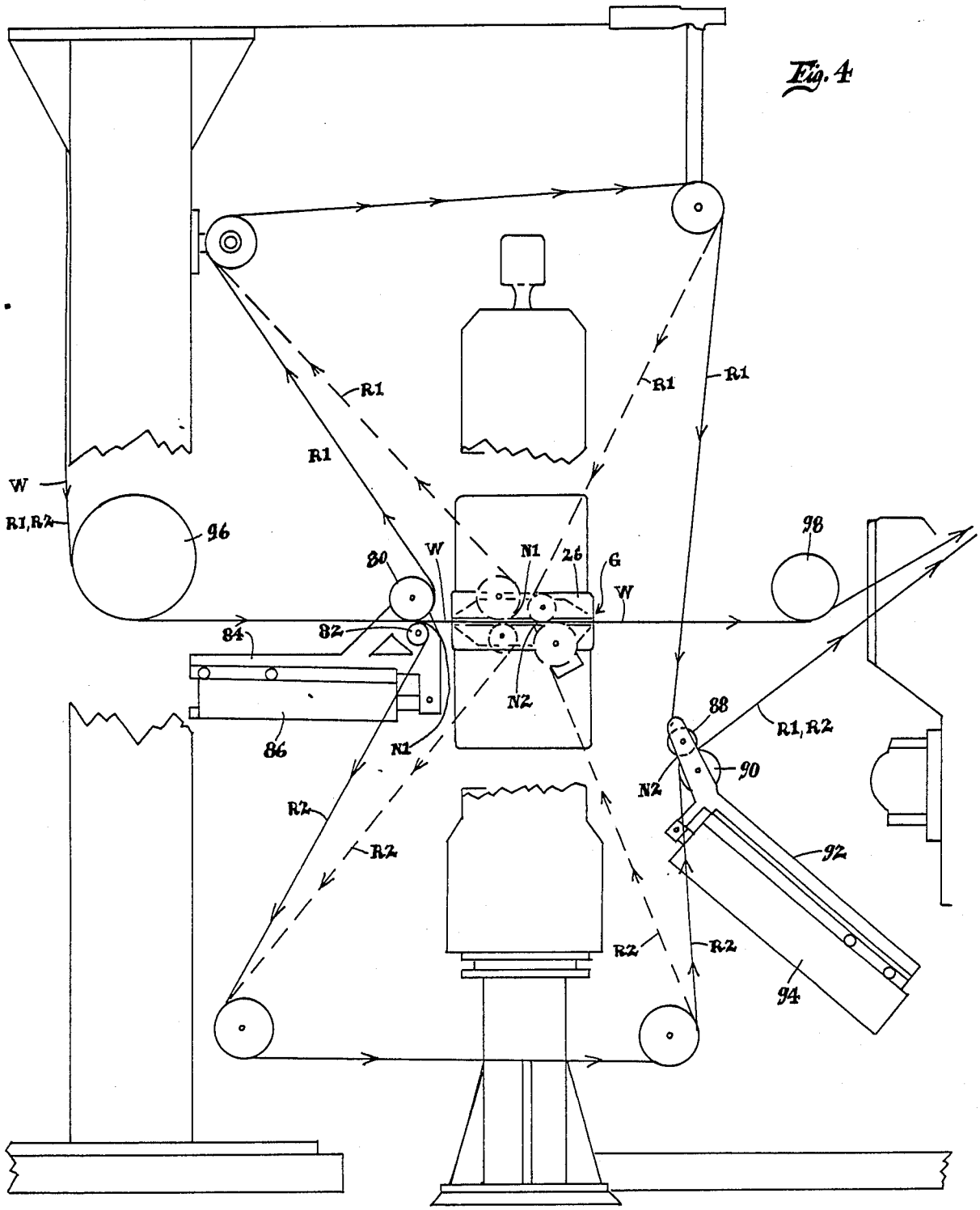
FIG. 4 is a side elevation view of a paper tailing device according to another embodiment of the invention.

FIG. 4 illustrates another embodiment of paper tailing device, in which the upstream portion comprises a pair of upstream sheaves 80 and 82 carried on a bracket 84 that is moved by a pneumatic cylinder 86. Unlike in the previous embodiment, the downstream portion of the paper tailing device is mounted below and at an angle with respect to the direction of travel of a web W through the gap G, and includes downstream sheaves 88 and 90 carried by a bracket 92 that is moved by a pneumatic cylinder 94. The paper tailing device is shown in its inoperative position, with the web passing over a last heated roll 96 of a drying section and then through the gap where its characteristics are sensed by the transversely moving calibrating head 26. From the gap, the web passes over a roll 98 and is led to a take-up roll (not shown).

Operation of the paper tailing device in transferring the leading end of an initial portion of a web across the gap G during guiding of the web through the drying section is substantially the same as for the embodiment of FIG. 1. During guiding of the web initial portion through the drying section, at which time a side edge of the web is between and guided by the overlapping carrier ropes R1 and R2, the cylinders 86 and 94 are operated to extend the upstream sheaves 80 and 82 and the downstream sheaves 88 and 90 to their positions shown in dashed lines, at which point the upstream and downstream sheaves and the associated outgoing and incoming carrier rope nips N1 and N2 are in closely facing relationship within the gap. Consequently, upon the leading side edge of the web exiting the outgoing nip, it is sufficiently close to the incoming nip that it automatically enters the incoming nip and is guided by the carrier ropes to the take-up roll. Upon completion of the threading operation, the drying section tensions the web and causes its side edge to move from between the carrier ropes as the web shifts sideways to its normal run position, whereupon the pneumatic cylinders 86 and 94 are operated to retract their associated brackets and sheaves to their inoperative positions out of the gap, so that the calibrating head 26 is then free to move transversely across the web and from side-to-side in the gap. As in the embodiment of FIG. 1, for each of the upstream and downstream pairs of sheaves, one of the sheaves has a smaller diameter than the other to decrease the pressure exerted on the web edge within the carrier ropes nips and permit the web edge to more freely move from between the carrier ropes as it shifts sideways to its run position.

While embodiments of the invention have been described in detail, various modifications and other embodiments thereof may be devised by one skilled in the art without departing from the spirit and scope of the invention, as defined in the appended claims.

What is claimed is:

1. A paper tailing device for a paper making machine in which an initial portion of a paper web is guided through the machine by being gripped along one of its side edges between overlapping carrier ropes that guide the initial portion though the machine and in which there is a gap across which the initial portion is to be transferred, said paper tailing device comprising a pair of upstream sheaves on an upstream side, with respect to the direction of web travel, of the gap, the carrier ropes being adapted to extend over said upstream sheaves and define an outgoing nip from the ropes at said upstream sheaves; a pair of downstream sheaves on a downstream side of the gap, the carrier ropes being adapted to extend over said downstream sheaves and define an incoming nip to the ropes at said downstream sheaves; and means for moving said upstream and downstream pairs of sheaves relative to and toward each other, during guiding of the initial portion of the web through the machine, to place said upstream and downstream pairs of sheaves and the outgoing and incoming nips into close facing relationship so that a leading side edge of the initial portion of the web, upon exiting the outgoing nip from the carrier ropes, is introduced into the incoming nip to the ropes and is thereby transferred across the gap, and for moving said upstream and downstream pairs of sheaves relative to and away from each other, after completion of guiding the web through the machine, to place said pairs of sheaves to opposite sides and outside of the gap.

2. A paper tailing device as in claim 1, further including upstream and downstream brackets respectively rotatably mounting said upstream and downstream pairs of sheaves, said moving means moving said brackets relative to each other.

3. A paper tailing device as in claim 1, wherein said means for moving comprises pneumatic cylinder means.

4. A paper tailing device as in claim 1, wherein said moving means moves both of said upstream and downstream pairs of sheaves toward and away from each other.

5. A paper tailing device as in claim 1, wherein one sheave of each of said upstream and downstream pairs of sheaves is of a smaller diameter than the other sheave.

6. A paper tailing device as in claim 1, wherein the carrier ropes form endless loops, and including means for giving and taking up slack in the carrier ropes upon movement of said upstream and downstream pairs of sheaves relative to and toward and away from each other.

7. A paper making machine, comprising a plurality of rotating rolls across which a paper web passes in moving through said machine; a gap in the path of travel of the web through said machine; overlapping carrier ropes that extend and move alongside the path of travel of the web through said machine, said carrier ropes, upon a paper web initially being guided through said machine, receiving between them a side edge of an initial portion of the web to guide the initial portion through said machine; and a paper tailing device for transferring the initial portion of the web across said gap during guiding of the web through said machine, said paper tailing device comprising a pair of upstream sheaves on an upstream side, with respect to the direction of web travel, of said gap; a pair of downstream sheaves on a downstream side of said gap, said carrier ropes extending over said upstream and downstream pairs of sheaves and defining an outgoing nip from said ropes at said upstream pair of sheaves and an incoming nip to said ropes at said downstream pair of sheaves; and means for moving said upstream and downstream pairs of sheaves relative to and toward each other, during guiding of the initial portion of the web through said machine, to place said outgoing and incoming nips in close facing relationship so that a leading side edge of the initial portion of the web, upon exiting said outgoing nip from said carrier ropes, is introduced into said incoming nip to said carrier ropes and thereby transferred across said gap, and for moving said upstream and downstream pairs of sheaves relative to and away from each other and to opposite sides and outside of said gap after completion of guiding the web through said machine.

8. A paper making machine as in claim 7, wherein said machine comprises a paper web drying section and at least some of said plurality of rolls are heated rolls.

9. A paper making machine as in claim 7, including a calibrating head movable in said gap transversely across the web for sensing characteristics of the web during operation of said machine, said upstream and downstream pairs of sheaves, when moved to opposite sides and outside of said gap, being out of the path of travel of said calibrating head.

10. A paper making machine as in claim 7, wherein said moving means moves said upstream and downstream pairs of sheaves generally horizontally toward and away from each other into and out of said gap.

11. A paper making machine as in claim 7, wherein said moving means moves one of said upstream and downstream pairs of sheaves generally horizontally into and out of said gap and moves the other of said pair of sheaves in both horizontal and vertical directions into and out of said gap.

12. A paper making machine as in claim 7, said paper tailing device further including upstream and downstream brackets respectively rotatably mounting said upstream and downstream pairs of sheaves, said moving means moving said brackets relative to each other.

13. A paper making machine as in claim 7, wherein said moving means includes pneumatic cylinder means.

14. A paper making machine as in claim 7, wherein said moving means moves both of said upstream and downstream pairs of sheaves.

15. A paper making machine as in claim 7, wherein one sheave of each of said upstream and downstream pairs of sheaves is of a smaller diameter than the other sheave.

16. A paper making machine as in claim 7, wherein said carrier ropes form endless loops, and including means for giving and taking up slack in said carrier ropes upon movement of said upstream and downstream pairs of sheaves relative to and toward and away from each other.

* * * * *